United States Patent [19]

Brewer

[11] 4,058,242

[45] Nov. 15, 1977

[54] CONNECTOR FOR CAMERA HARNESSES

[76] Inventor: Robert A. Brewer, 15 Castle Park Way, Oakland, Calif. 94611

[21] Appl. No.: 717,155

[22] Filed: Aug. 24, 1976

[51] Int. Cl.[2] ..... A45F 5/00; F16B 35/04

[52] U.S. Cl. ..... 224/5 V; 24/217 R; 85/9 R; 354/81

[58] Field of Search ..... 224/5 V, 5 H, 5 R, 5 A, 224/5 B, 26 R, 26 B, 3, 2 C; 354/82, 293, 84; 352/242; 24/219, 217, 213, 214, 216, 220, 215, 73 HC, 105, 108, 77, 166, 163, 164; 85/9 R

[56] References Cited

U.S. PATENT DOCUMENTS

| | | | |
|---|---|---|---|
| 1,691,013 | 11/1928 | Johnson | 85/9 R |
| 2,586,954 | 2/1952 | Juliano | 354/81 |
| 2,614,471 | 10/1952 | Markowitz | 354/293 |
| 2,990,089 | 6/1961 | Nystrom | 224/5 V |
| 3,176,602 | 4/1965 | Wilt | 354/293 X |
| 3,305,148 | 2/1967 | Zimmerman | 224/5 V |
| 3,884,403 | 6/1975 | Brewer | 224/5 V |
| 3,966,101 | 6/1976 | Taylor | 354/82 X |

*Primary Examiner*—Robert J. Spar
*Assistant Examiner*—Jerold M. Forsberg
*Attorney, Agent, or Firm*—James R. Cypher

[57] ABSTRACT

A connector having a thumb screw adapted for connection to a camera and to a flexible body harness carrying a snap connector. The connector includes a washer with an opening for receiving therethrough and retaining the shaft of the thumb screw. The underside of the washer is surfaced with resilient material for resiliently engaging the bottom of the camera. The head of the thumb screw is formed with one portion of a snap connector for releasably engaging the snap connector carried by the harness.

5 Claims, 17 Drawing Figures

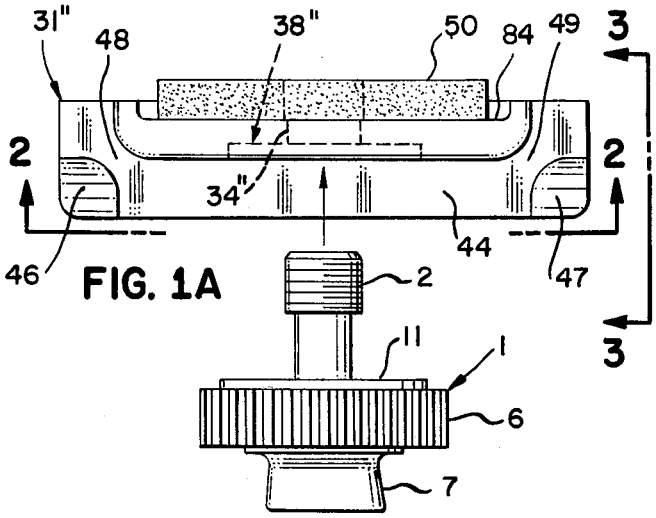
FIG. 1A
FIG. 1
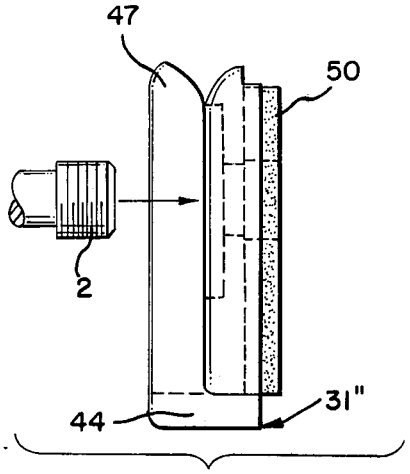
FIG. 3
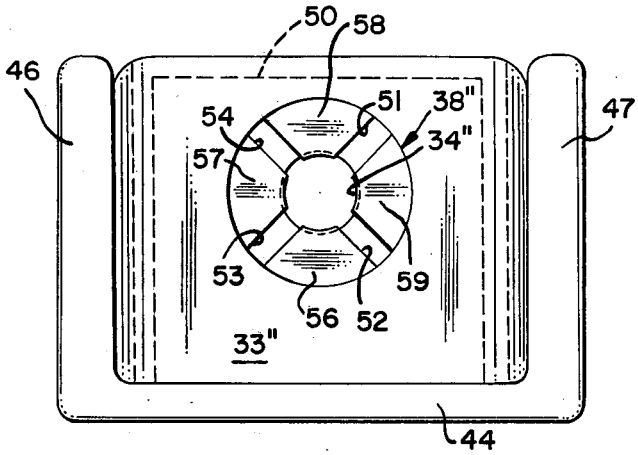
FIG. 2
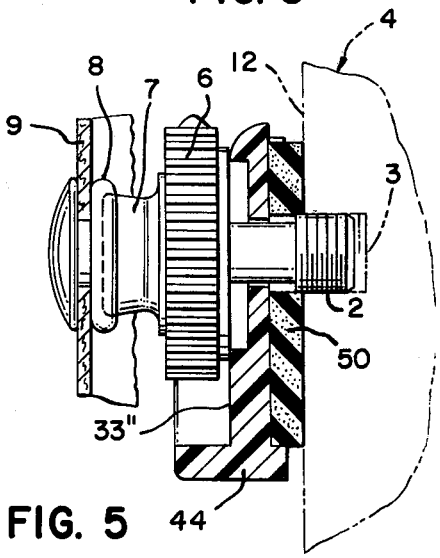
FIG. 5
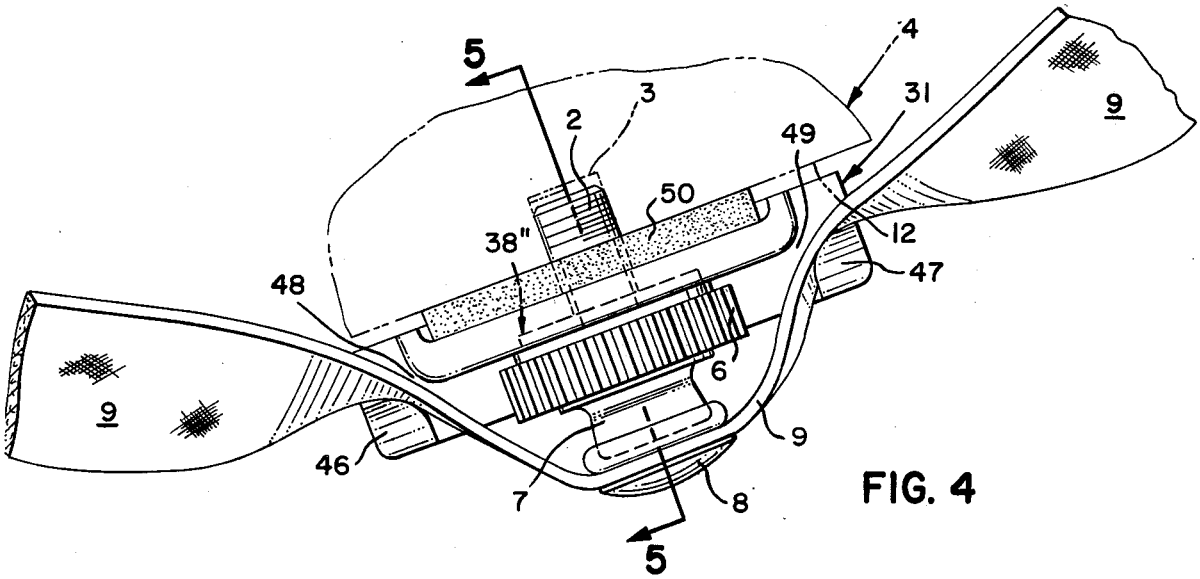
FIG. 4

CONNECTOR FOR CAMERA HARNESSES

BACKGROUND OF THE INVENTION

In my U.S. Pat. No. 3,884,403 granted May 20, 1975, I disclosed a harness for carrying cameras and other articles using Velcro hook and loop fasteners as a connector for attaching the camera to the harness. While this harness was capable of restraining the camera under most conditions, the Velcro hook and loop fastener was subject to accidental disconnection under stresses caused by mountain climbing, river rafting, scuba diving, running or fast horseback riding and camera damage could ensue. Even for normal activities, there was some objection by owners of very expensive cameras who did not wish to permanently attach any type of connector to the camera. Still others with expensive cameras desired a connector which could not be so easily detached from the harness to prevent or discourage loss by theft.

SUMMARY OF THE INVENTION

The gist of the present invention is the provision of one part of a snap body fastener on the head of a thumbscrew adapted for attachment to the tripod nut of a camera and the other part of the snap body fastener on a portion of a transverse chest strap.

An object of the present invention is to provide an improved connector between a camera harness and the camera.

Another object is to provide a connector which can be releasably attached to the camera wherein no part of the connector is ever permanently attached to the camera.

A further object is to provide a connector which will not mar or damage the camera.

Still another object is to provide a connector which cooperates with the camera harness to hold the camera secure from lateral movement as well as movement outward from the body of the photographer.

Still another object is to provide a connector which will enable the photographer to prevent the camera from accidentally moving upwardly.

Another object is to provide a connector which will securely hold the camera and reduce the risk of loss or theft of the camera.

Another object is to provide a degree of security from accidental disconnection beyond that afforded by the snap coupling alone.

Still another object is to provide a connector which will reduce the risk of damage to the camera by preventing accidental swinging of the camera away from the wearer.

A still further object is to provide a connector which will accomplish all of the above objectives to any portable device which is formed with a tripod type nut.

BRIEF DESCRIPTION OF THE DRAWINGS

FIG. 1 is a front elevation view of one embodiment of the present invention on an enlarged scale.

FIG. 1A is front elevation view of a rigid washer used with one form of the invention.

FIG. 2 is a top plan view of a portion of the connector shown in FIG. 1A as viewed along line 2—2.

FIG. 3 is an end elevation view of a portion of the connector shown in FIG. 1A as viewed along line 3—3.

FIG. 4 is a front elevation view of the connector of the present invention. A portion of a typical camera is shown in phantom line to illustrate the manner in which the connector is adapted for releasable connection thereto. A portion of a flexible strap such as the strap used with my harness described in U.S. Pat. No. 3,884,403 is shown carrying a snap connector which is snap connected to the connector of the present invention.

FIG. 5 is a cross sectional view taken along line 5—5 of FIG. 4.

DESCRIPTION OF THE PREFERRED EMBODIMENTS

Figure 6:
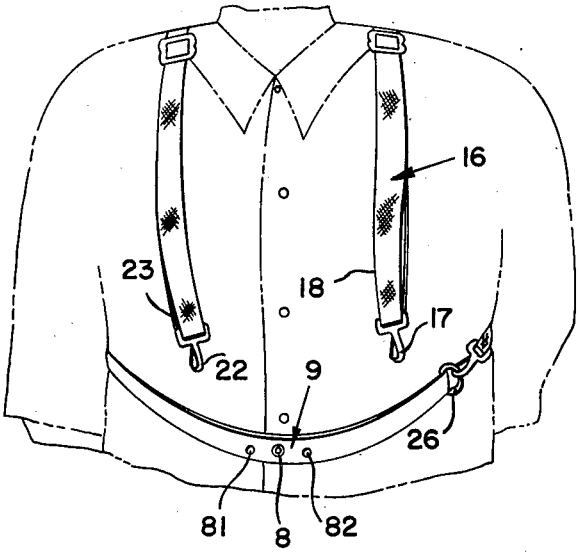
FIG. 6 is a front view of the strap carrying a portion of the snap release member. A portion of a person is shown in phantom to illustrate the manner in which a strap harness may be worn.

The connector of the present invention is shown in FIG. 1 in its most basic form and consists of a thumb screw connector member 1 having a threaded shaft 2 adapted for threadable connection with the threaded screw nut 3 formed in a camera 4 or other type of portable equipment, and an enlarged head member 6 adapted for manual turning; a portion 7 of a snap fastener member operably connected to the shaft and a mating portion 8 of the snap fastener member is connected to the transverse flexible member 9 for releasable coupling with the portion 7 of the snap fastener member connected to the thumb screw head.

The enlarged head member is preferably knurled or patterned so that it may be grasped tightly between two fingers with a sufficient grip to fasten the connector tightly to the camera tripod nut.

Figure 7:
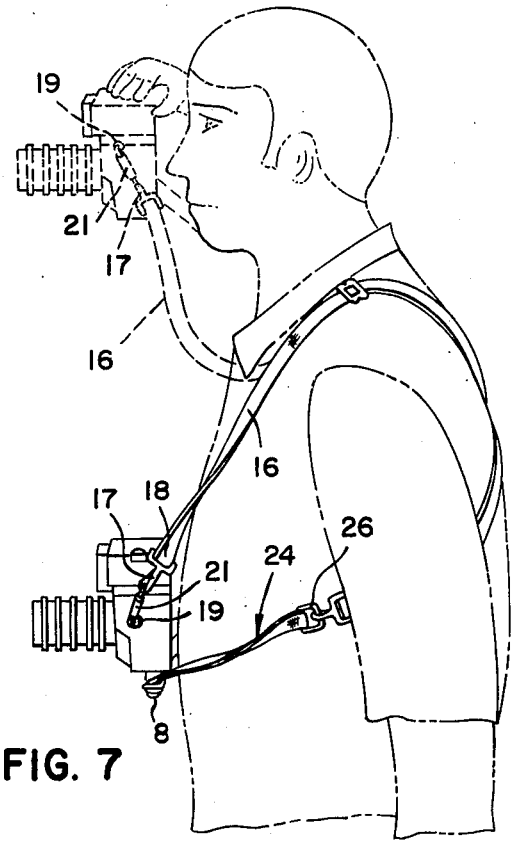
FIG. 7 is a side view of my connector. A camera and photographer are drawn in phantom line to illustrate the use of the connector.

FIGS. 6 and 7 show a typical harness with which the connector may be used. The harness illustrated is similar to the harness described in my U.S. Pat. No. 3,884,403 and in my application for Letters Patent, Ser. No. 558,781 filed Mar. 17, 1975, now U.S. Pat. No. 4,033,488.

The harness consists briefly of a strap 16 consisting of a single flexible non-elastic elongated member, a first spring releasable coupling member 17 attached to a first end 18 of the strap and dimensioned to releasably couple directly to an apertured coupling element 19 on the camera or other article or to a function separating connection 21 such as the connector described in my U.S. Pat. application, Ser. No. 666,883 filed Mar. 15, 1976, now U.S. Pat. No. 4,024,608, and a second spring releasable coupling member 22 attached to a second end 23 of the strap which couples directly to a second apertured coupling element on the camera or to a second connector.

The harness shown in FIGS. 6 and 7 includes an extension strap 24 having a "D" ring 26 attached at one end, but the snap and "D" ring are not essential and may be omitted.

The basic connector illustrated in FIG. 1 is used by simply screwing the threaded shank into the tripod nut threaded opening on the camera or other article. The harness is then placed about the shoulders and chest as shown in FIG. 6 and the connectors are attached to the lugs of the camera. The snap fastener 7 on the connector 1 is then pressed against the snap fastener 8 attached to the harness. The camera or other article will remain securely against the body of the person until a picture is to be taken. If the harness is worn loosely, it is not necessary to uncouple the snaps in order to raise the camera to picture taking height. If the harness is worn tightly, then, to take a picture it is only necessary to unsnap the snap couplings and raise the camera to eye level. It is a simple matter to couple the snap couplings by pressing them together with the fingers.

To protect the finish of the camera and to improve the holding of the thumbscrew, a circular or rectangular washer may be inserted between surfaces 11 (flat annular surface of thumbscrew) and 12 (generally flat surface of camera body). The washer may be constructed so that the interface between the washer and the camera has a higher coefficient of friction than the interface between the washer and the thumbscrew. Thus the thumbscrew, when rotated as it is being inserted in the tripod nut, slides with respect to the washer, and the washer does not slide with respect to the camera. This protects the camera finish from abrasion by the washer.

Figure 8:
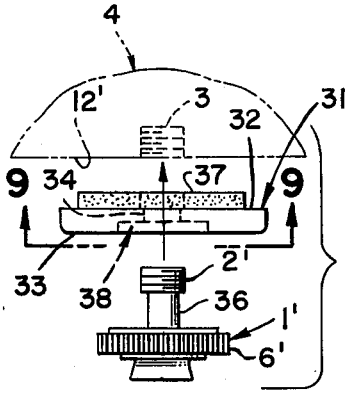
FIG. 8 is a front elevation view of another form of my invention. The portions of the device are shown in an "exploded" view. A portion of a camera in phantom line is shown to illustrate the manner in which the connector is adapted for connection thereto.
Figure 11:
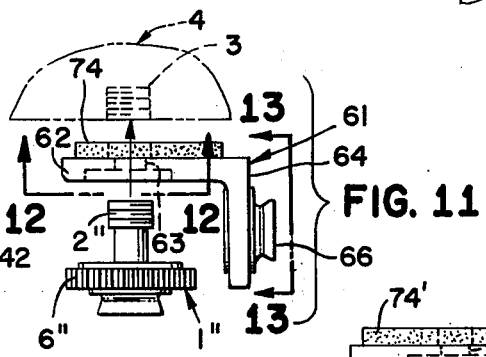
FIG. 11 is a side elevation view of still another form of the invention. A portion of a camera is shown in phantom line. The connector is shown in an "exploded" view. The arrow illustrates the arrangement of the parts.
Figure 9:
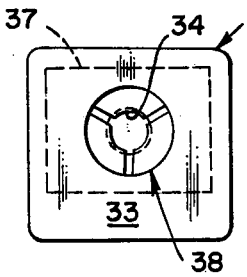
FIG. 9 is a top plan view of the connector of FIG. 8 taken along line 9—9.

Another form of the invention is shown in FIGS. 8 and 9. The connector 1' includes a rigid washer member 31 which has an upper face 32, a lower face 33 and is formed with an opening 34 therethrough for placement in surrounding relation to the threaded shank 2'. To prevent separation of the rigid washer and the connector, a portion 36 of the shank between the threaded end 2' and the enlarged head portion 6' is formed with a reduced diameter. The diameter of the section is less than the diameter of the opening in the rigid washer, while the diameter of the threaded portion 2' of the connector is greater than the diameter of the opening in the rigid washer.

A resilient member 37 such as a thin rectangular piece of sponge rubber is attached to the upper face 32 of the washer and is adapted for contact with the camera body 12'.

To permit the threaded portion of the connector shank to pass through the opening in the washer, an annular area 38 surrounding the opening is flexible. The annular area may be formed from a flexible material and attached to the rigid material.

Figure 9A:
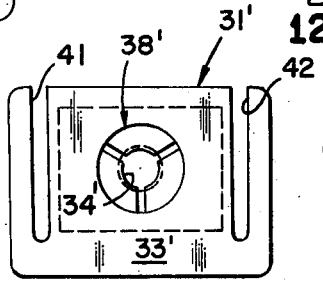
FIG. 9A is a top plan view of still another form of the invention.
Figure 12:
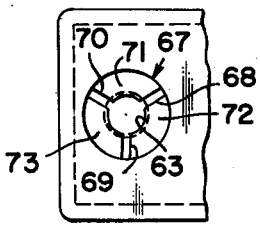
FIG. 12 is a bottom view of a portion of the device shown in FIG. 11 taken along line 12—12.

In order to more securely hold the camera or other article to the harness, another form of the invention is illustrated in FIG. 9A. The rigid washer 31' is formed with a pair of slotted openings 41 and 42 on opposite sides. The strap is threaded through the openings. The washer is in all other respects identical to the washer of FIGS. 8 and 9 including opening 34', flexible annular area 38' and lower face 33'.

Still another form of the invention is illustrated in FIGS. 1A, 2, 3, 4 and 5 in which the rigid washer 31" is formed with a side member 44 which extends below and outwardly from the lower face 33" of the washer. A pair of arms 46 and 47 attached to the side member at locations positioned below and outwardly from the lower face of the washer form openings 48 and 49 for receiving the transverse portion 9 of the flexible strap. To protect the finish of the camera and provide for better locking of the connector to the camera, a piece of sponge rubber 50 or plastic having a high coefficient of friction is attached to or made a part of the upper side of the rigid washer.

When the thumb screw is threaded into the camera tripod nut, the arms 46 and 47 are oriented forward by the photographer and they are held in that position by the thumb screw. The photographer puts the strap on and snaps the strap onto the thumb screw. Then, by threading the strap through slots 48 and 49, a further degree of security from accidental disconnection is provided beyond what is provided by the snap coupling alone. Tension on the webbing instead of tending to disconnect the snap coupling, tends to hold the snap elements more firmly together.

Even though the connector is very secure from accidental uncoupling, it can be quickly and easily disconnected by unthreading the webbing from one prong, releasing the snap coupling, and then unthreading the webbing from the other prong.

Another means for permitting the threaded portion of the connector shank to pass through the smaller diameter opening in the rigid washer is to construct the annular area 38" of the rigid washer which surrounds the opening so that it has a substantially reduced thickness. Further, the annular area should be formed with a plurality of radial slots, 51, 52, 53, and 54 which intersect the opening 34". The washer is formed from a material so that the main portion is rigid and the annular area is flexible with a spring memory to return the segments 56, 57, 58, and 59 to an original position after passage of the shaft therethrough.

The forms of the invention illustrated in FIGS. 11–14 disclose a construction in which the connector may be attached to the camera without placing a twist in the transverse strap member 9 of the harness. An "L" shaped member 61 having a base 62 formed with an opening 63 and a side member 64 is provided. A thumb screw member 1" having a threaded shank 2" adapted for threadable connection with the threaded screw nut 3 formed in the camera body member 4 having an enlarged head member 6" adapted for manual turning is provided. A portion 66 of a snap fastener member is connected to the side member 64.

A mating portion 8'' of the snap fastener member is connected to the transverse flexible member 9 for releasable coupling with the portion of the snap fastener member connected to the "L" shaped member. The base 62 includes an annular area 67 surrounding the opening 63 which has a thickness substantially less than the thickness of the base. The annular area is formed with a plurality of radial slots 68, 69, and 70 which intersect the opening. The base is formed from a material such as plastic so that the main portion of the base is rigid and the annular area is flexible with a spring memory to return the segments 71, 72, and 73 to an original position after being deformed by the passage of the shank therethrough. A sponge rubber or plastic resilient member 74 having a high coefficient of friction is attached to the upper side of the base.

Figure 13A:
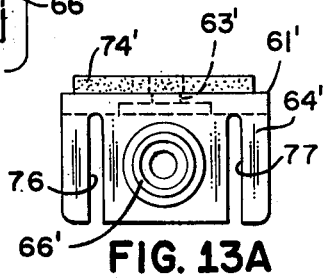
FIG. 13A is an end view of still another form of the connector which is most nearly similar to the form of the invention shown in FIGS. 11, 12, 13 and 14.
Figure 13:
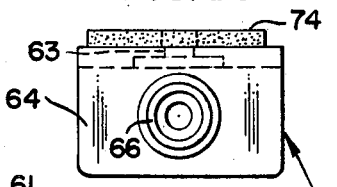
FIG. 13 is an end view of the connector shown in FIG. 11 taken along line 13—13.
Figure 10:
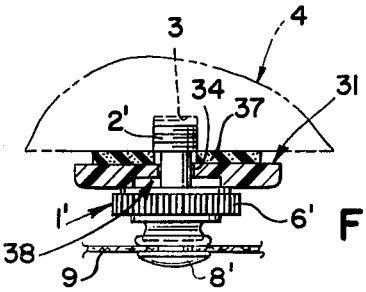
FIG. 10 is an end view of the form of the invention shown in FIG. 8 with portions of the device in cross section. A portion of a camera is shown in phantom line with the connector attached thereto. A portion of the harness illustrated in FIGS. 6 and 7 is shown with the snap connector firmly attached to the connector of the present invention.
Figure 14:
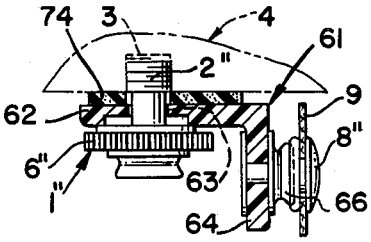
FIG. 14 is an end view of the device of FIG. 11 with the parts of the connector assembled and connected to the camera and flexible strap harness. Portions of the device are in cross section for purposes of clearly illustrating the invention.

A modified form of the invention shown in FIGS. 11, 12, 13 and 14 is shown in FIG. 13A. The "L" shaped connector 61' is identical to the "L" shaped connector previously described except that side member 64' is formed with slots 76 and 77 to threadably receive strap 9 therethrough. The connector is formed with opening 63' and snap 66' is connected to the side. Preferably a sponge rubber or plastic member 74' is attached to the upper side of the base.

The harness and connector of the present invention is particularly adapted for underwater photography in which the diver at times will be literally standing on his head. Under such conditions, the harness illustrated will not prevent the camera from moving over the diver's head unless restained. The strap may be formed with a pair of openings 81 and 82. Strings or thongs may then be threaded through the openings and attached to the diver's belt.

As an example, the construction of the form of the invention illustrated in FIGS. 1–4 is as follows: The overall dimensions of the washer member may be 1¾ inches × 1 3/16 inches × ⅜ inches. The opening in the member is 15/64 inches diameter and the annular area 38'' is ⅝ inches diameter. The annular area is countersunk to a depth of 1/16 inches. The slots 51 to 54 have a width of 1/16 inches. The arms 46 and 47 have a thickness of 3/16 inches and a width of 3/16 inches. The base 32 is indented 1/16 inches in a rectangle 84 for more securely holding the sponge rubber member.

I claim:

1. A connector for releasably attaching a camera to a harness, said camera having a threaded screw nut formed in the body and strap lugs adapted for attachment to coupling members on the harness, said harness having a transverse flexible member adapted for wearing across the chest of the wearer, said connector comprising:

a. a thumb screw member having a threaded shank adapted for threadable connection with said threaded screw nut formed in said camera body member and an enlarged head member adapted for manual turning;

b. a portion of a snap fastener member connected to said enlarged head of said thumb screw;

c. a mating portion of said snap fastener member connected to said transverse flexible member for releasable coupling with said portion of said snap fastener member connected to said thumb screw head;

d. a rigid washer member having an upper and lower face and formed with an opening therethrough for placement in surrounding relation to said threaded shank;

e. said threaded shank having an unthreaded portion of reduced diameter between said threaded end and said enlarged head portion;

f. a resilient member attached to the lower face of said washer portion adapted for contact with said camera body;

g. said opening in said washer member having a dimension greater than said unthreaded portion of said shank and smaller than the threaded portion of said shank;

h. said rigid washer being formed with an annular area surrounding said opening which is flexible to permit the insertion of said shank through said opening; and i. said rigid washer is formed with a pair of slotted openings on opposite sides adapted for releasably receiving said transverse harness strap.

2. A connector for releasably attaching a camera to a harness, said camera having a threaded screw nut formed in the body and strap lugs adapted for attachment to coupling members on the harness, said harness having a transverse flexible member adapted for wearing across the chest of the wearer, said connector comprising:

a. a thumb screw member having a threaded shank adapted for threadable connection with said threaded screw nut formed in said camera body member and an enlarged head member adapted for manual turning;

b. a portion of a snap fastener member connected to said enlarged head of said thumb screw;

c. a mating portion of said snap fastener member connected to said transverse flexible member for releasable coupling with said portion of said snap fastener member connected to said thumb screw head;

d. a rigid washer member having an upper and lower face and formed with an opening therethrough for placement in surrounding relation to said threaded shank;

e. said threaded shank having an unthreaded portion of reduced diameter between said threaded end and said enlarged head portion;

f. a resilient member attached to the lower face of said washer portion adapted for contact with said camera body;

g. said opening in said washer member having a dimension greater than said unthreaded portion of said shank and smaller than the threaded portion of said shank;

h. said rigid washer being formed with an annular area surrounding said opening which is flexible to permit the insertion of said shank through said opening;

i. said washer is formed with a side member extending below and outwardly from the lower face of said washer; and j. a pair of arms attached to said side member at locations positioned below and outwardly from the lower face of said washer forming an opening between said arms and the lower face of said washer for receiving said transverse portion of said flexible strap therethrough.

3. A connector as described in claim 2 comprising:

a. said annular area of said rigid washer surrounding said opening is formed with a thickness substantially less than the thickness of said washer;

b. said annular area is formed with a plurality of radial slots intersecting said opening; and c. said washer is formed from a material so that the main portion of said washer is rigid and the annular area is flexible with a spring memory to return to an original position when deformed by the passage of said shaft therethrough.

4. A connector for releasably attaching a camera to a harness, said camera having a threaded screw nut formed in the body and strap lugs adapted for attachment to coupling members on the harness, said harness having a transverse flexible member adapted for wearing across the chest of the wearer, said connector comprising:

a. an "L" shaped member including a base formed with an opening therethrough and a side member;

b. a thumb screw member having a threaded shank adapted for threadable connection with said threaded screw nut formed in said camera body member and an enlarged head member adapted for manual turning;

c. a portion of a snap fastener member connected to said side member;

d. a mating portion of said snap fastener member connected to said transverse flexible member for releasable coupling with said portion of said snap fastener member connected to said "L" shaped member;

e. said base includes an annular area surrounding said opening which has a thickness substantially less than the thickness of said base;

f. said annular area is formed with a plurality of radial slots intersecting said opening; and g. said base is formed from a material so that the main portion of said base is rigid and the annular area is flexible with a spring memory to return to an original position when deformed by the passage of said shank therethrough.

5. A connector as described in claim 4 comprising:

a. said side member is formed with a pair of slots positioned on opposite sides of said snap fastener member adapted for receiving said flexible strap therethrough.

* * * * *